United States Patent [19]

Oppl et al.

[11] 4,445,320

[45] May 1, 1984

[54] SPINDLE BRAKE

[75] Inventors: Günter Oppl; Günther Schmitt, both of Hammelburg, Fed. Rep. of Germany

[73] Assignee: FAG Kugelfischer Georg Schäfer & Co., Schweinfurt, Fed. Rep. of Germany

[21] Appl. No.: 370,054

[22] Filed: Apr. 20, 1982

[30] Foreign Application Priority Data

Apr. 25, 1981 [DE] Fed. Rep. of Germany ..... 3116480

[51] Int. Cl.[3] ..... D01H 1/241

[52] U.S. Cl. ..... 57/88; 57/130; 242/156

[58] Field of Search ..... 57/88, 130; 242/28, 242/156, 156.2, 129.8

[56] References Cited

U.S. PATENT DOCUMENTS

| | | | |
|---|---|---|---|
| 676,057 | 6/1901 | Tynan | 57/88 |
| 2,449,773 | 9/1948 | Hargreaves et al. | 57/88 X |
| 2,718,747 | 9/1955 | Honig | 57/88 |
| 3,116,591 | 1/1964 | Muller | 57/88 |

FOREIGN PATENT DOCUMENTS

| | | |
|---|---|---|
| 2048959 | 8/1973 | Fed. Rep. of Germany . |
| 2922606 | 12/1980 | Fed. Rep. of Germany . |

*Primary Examiner*—Donald Watkins

*Attorney, Agent, or Firm*—Karl F. Ross; Herbert Dubno

[57] ABSTRACT

A spindle brake for a spinning or twisting machine has a pair of arms whose jaws are engageable with the whorl of a spinning or twisting spindle. One of these arms carries a belt-lifting roller adapted to lift the belt away from the whorl when the brake is actuated thereby preventing friction between the belt and the immobilized whorl.

7 Claims, 3 Drawing Figures

SPINDLE BRAKE

FIELD OF THE INVENTION

Our present invention relates to a spindle brake for spinning and twisting spindles and, more particularly, to a brake for the whorl of a spinning or twisting frame spindle.

BACKGROUND OF THE INVENTION

The spindles of a spinning or twisting frame are generally arranged in rows with respective whorls tangentially engaging a drive belt which rotates the spindle.

For each spindle, an individually actuatable brake is generally provided and brakes of a wide variety of constructions have been proposed and used for this purpose.

For example, in German patent document (Open Application) No. 29 22 606 a two-jaw brake is disclosed. The jaws are each carried on respective arms and the latter are urged against the spindle or a member connected thereto by tongs action.

Each of the arms is connected by a respective pin pivotally with a support at the upper end of the spindle housing.

While this arrangement is effective to bring the spindle to standstill, it has the disadvantage that the tangential belt continues to rub along the whorl which causes frictional distortion of the spindle and applies unnecessary stress to the bearing, at least in part as a result of the heat generated by the frictional action.

Another disadvantage of this system is that it requires a respective housing individual to each brake and thus complicates the mounting or dismounting of the brakes by requiring assembly or disassembly of the respective housings.

An earlier spindle brake is described in German Pat. No. 20 48 959 in which a single shoe brake cooperates, via a leaf spring device, with a roller adapted to lift the belt away from the immobilized spindle during the braking thereof.

The construction of this brake is complex and hence expensive and somewhat unreliable. Furthermore, this device has the disadvantage that one-sided force is applied to the whorl and the spindle during the braking action and can mechanically stress the bearings and reduce the operating life of the spindle or adversely affect its concentricity.

OBJECTS OF THE INVENTION

It is the principal object of the present invention to provide an improved spindle brake for yarn-spinning and yarn-twisting spindles and frames whereby the disadvantages of the earlier systems are avoided.

Another object of this invention is to provide an improved spindle brake which is capable of providing balanced braking forces to the spindle, does not generate inordinate amounts of heat during the braking operation and has a long and reliable operating life.

Still another object of our invention is to provide a spindle brake which can be easily mounted and dismounted and is easily maintained.

SUMMARY OF THE INVENTION

These objects and others which will become apparent hereinafter are attained, in accordance with the invention, in a jaw-type spindle brake which comprises a pair of braking jaws disposed diametrically opposite one another across the spindle axis and juxtaposed with the whorl, each brake jaw being mounted on a respective arm.

According to the invention a single pivot is provided to interconnect these arms whereby the jaws can pivot relative to one another in opposite senses about this pivot, while a free end of one of the arms is provided with a belt-lifting roller which, upon actuation of the brake, is positioned to lift the belt away from the whorl as the brake jaws engage the latter to immobilize the spindle.

According to a feature of the invention a spreading spring, e.g. of the hairpin or torsion type, biases the brake jaws apart and is mounted around the pivot to urge the arms away from one another. A cam arrangement is provided to swing the arms inwardly to brake the spindle.

We have found it to be highly advantageous to mount this pivot and hence the assembly for the arms, jaws, spring and pivot, upon a support plate individual to the respective brake and removable from the spinning frame.

To this end, the mounting plate can be provided with one or more guide pins which can engage in respective recesses or bores of the spinning frame for proper alignment of the brake. The support plate may be magnetic or can be provided with magnets so that magnetic means is utilized to retain the plate on the frame.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
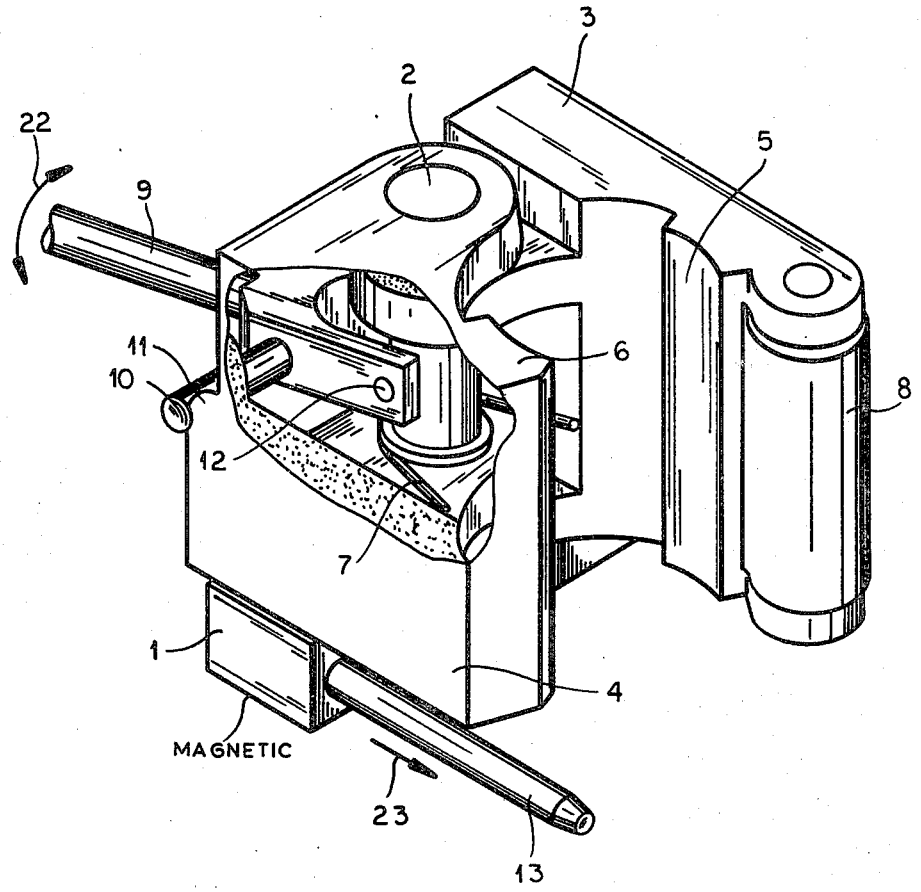
FIG. 1 is a perspective view, partly broken away, and illustrating the internal elements thereof.

A brake according to the invention has been shown in FIG. 1. It is understood that a brake of this type can be provided for each spindle. However, a single brake can, if required, be utilized to service a spinning frame with a 120 spindles, by simply positioning the brake at the spindle at which braking is required since an important feature of the invention is that the entire brake assembly is mounted on a plate which can be quickly removed from one position and fitted onto another position of the machine.

Figure 2:
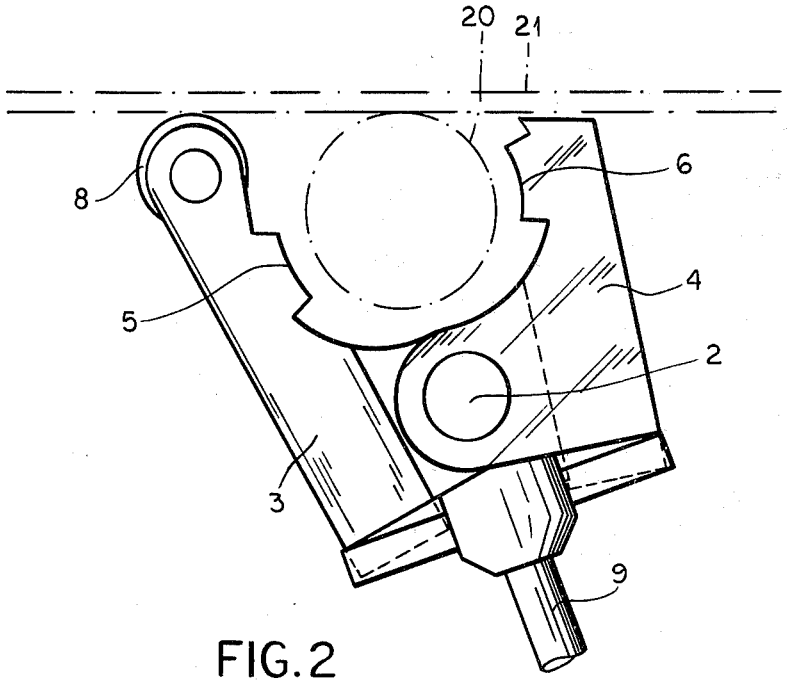
FIG. 2 is a diagrammatic plan view showing the brake in its unactuated state.
Figure 3:
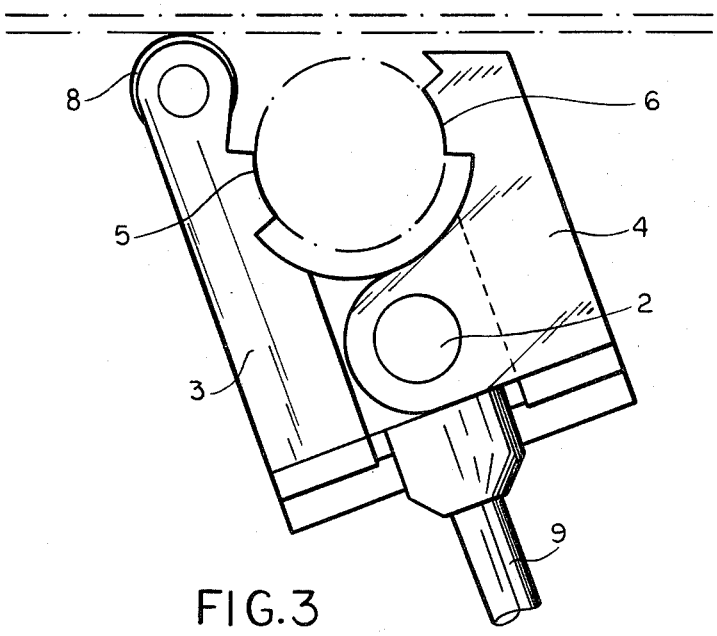
FIG. 3 is a view similar to FIG. 2 but showing the brake in its actuated state.

In FIGS. 2 and 3 of the drawing, the whorl is represented at 20 and its drive belt at 21 in dot-dash lines.

The brake comprises a support plate 1 provided with a pair of laterally extending guide pins 13 of which only one is visible in the drawing. A pivot pin 2 extends upwardly from this plate and forms a common pivot for a pair of arms 3 and 4.

The arms 3 and 4 carry a respective brake shoe or jaw 5 or 6, the jaw being disposed diametrically opposite one another across the whorl (see FIG. 3). The arms 3 and 4 are biased outwardly by a hairpin spring whose eye is fitted over the pin 2 (see FIG. 1).

As its free end turned toward the tangential belt 21, the arm 3 carries an idler roller 8 which serves to lift the belt from the whorl of the spindle which itself has not been shown but is of conventional design.

The opening and closing of the brake device is effected by a belt-crank lever 9 whose swinging movement about a pin 12 fixed to the pivot 2 is represented by the arrow 22.

The lever 9 is provided with a camming rod 10 adapted to ride upon curved camming surfaces 11 of the arms 3 and 4 so that a swinging movement of the lever 9 will cause the camming surfaces to engage one another and pivot the arms inwardly toward one another.

The plate 1 can be a magnet or can contain magnets to permit it to be retained by magnetic force in the direction of arrow 23 on the spinning frame.

As can be seen from FIG. 2, in the unactuated position of the brake, the roller 8 can be retracted somewhat by the spring 7 from the belt 21 and the jaws 5 and 6 are spread apart to enable the whorl to rotate while being driven by the belt.

When the lever 9 is swung to actuate the brake, the jaws 5 and 6 are pressed against the whorl (FIG. 3) and the roller 8 lifts the belt from the whorl so that there is no wear of the whorl or the spindle thereof.

Each spindle station of the machine frame can be provided with bores or recesses for the pins 13 so that the brake can be moved from station to station.

We claim:

1. A spindle brake for a spinning or twisting spindle of the type in which a tangential belt engages a whorl on a spinning or twisting machine, said brake comprising:

a pair of brake jaws juxtaposed with one another across said whorl;

respective arms carrying said jaws, said arms being connected at one end by a common pivot so that said arms are swingable toward and away from each other about said pivot;

means for actuating said brake to swing said arms toward each other and engage said jaws with said whorl;

a belt-lifting roller at the other end of one of said arms engageable with said belt upon actuation of the brake to lift said belt from said whorl; and a spreading spring biasing said arms away from one another, said pivot and said arms being mounted upon a support plate removably attachable to said machine.

2. The brake defined in claim 1 wherein said actuating means includes a lever-cam means for swinging said arms toward one another.

3. The brake defined in claim 1 wherein said plate is provided with at least one guide pin for locating said brake on said machine, said machine having a plurality of spindles with respective locations adapted to receive said pin, whereby said brake can be removed from position to position along said machine.

4. The brake defined in claim 1, further comprising magnetic means for retaining said plate on said machine.

5. A spindle brake for a spinning or twisting spindle of the type in which a tangential belt engages a whorl on a spinning or twisting machine, said brake comprising:

a support plate removably attachable to said machine;

a pair of brake jaws juxtaposed with one another across said whorl;

respective arms carrying said jaws, said arms being connected at one end by a common pivot so that said arms are swingable toward and away from each other about said pivot, said pivot mounting said arms on said support plate;

lever and cam means engageable with said pivot, and said arms on said plate for swinging said arms toward each other and engaging said jaws with said whorl; and a belt-lifting roller at a free end of one of said arms engageable with said belt upon actuation of the brake to lift said belt from said whorl.

6. The brake defined in claim 5 wherein said plate is provided with at least one guide and for locating said brake on said machine, said machine having a plurality of spindles with respective locations adapted to receive said pin, whereby said brake can be moved from position to position along said machine.

7. The brake defined in claim 5, further comprising magnetic means for retaining said plate on said machine.

* * * * *